US006718741B1

(12) United States Patent
Weder et al.

(10) Patent No.: US 6,718,741 B1
(45) Date of Patent: Apr. 13, 2004

(54) APPARATUS FOR SECURING A DECORATIVE COVER ABOUT A FLOWER POT

(75) Inventors: Donald E. Weder, Highland, IL (US); Michael R. Klemme, Maryville, IL (US); Sonny K. Burnside, St. Louis, MO (US); William F. Straeter, Highland, IL (US); Andrew Weder, Highland, IL (US); Wanda M. Weder, Highland, IL (US)

(73) Assignee: Southpac Trust International, Inc., Rarotonga (CK)

( * ) Notice: Subject to any disclaimer, the term of this patent is extended or adjusted under 35 U.S.C. 154(b) by 0 days.

(21) Appl. No.: 10/118,748

(22) Filed: Apr. 9, 2002

(51) Int. Cl.[7] ..... B65B 67/08; B65B 11/00

(52) U.S. Cl. ..... 53/592; 53/585; 53/580; 53/582; 53/390; 53/176

(58) Field of Search ..... 53/399, 592, 585, 53/580, 571, 219, 390, 176, 582; 224/160, 161, 646, 647, 628, 585

(56) References Cited

U.S. PATENT DOCUMENTS

| | | | |
|---|---|---|---|
| 524,219 | A | 8/1894 | Schmidt |
| 732,889 | A | 7/1903 | Paver |
| 950,785 | A | 3/1910 | Pene |
| 1,044,260 | A | 11/1912 | Schloss |
| 1,063,154 | A | 5/1913 | Bergen |

(List continued on next page.)

FOREIGN PATENT DOCUMENTS

| | | |
|---|---|---|
| AU | 4231978 | 6/1979 |
| BE | 654427 | 1/1965 |
| CH | 560532 | 4/1975 |
| DE | 15550 | 6/1900 |
| DE | 345464 | 12/1921 |

(List continued on next page.)

OTHER PUBLICATIONS

Speed Cover Brochure, "The Simple Solution For Those Peak Volume Periods", Highland Supply Corporation, ©1989.
"Speed Sheets and Speed Rolls" Brochure, Highland Supply Corporation, ©1990.
"Color Them Happy with Highlander Products" ©1992.
"Costa Keeps the Christmas Spirit", Supermarket Floral, Sep. 15, 1992.
"Super Seller", Supermarket Floral, Sep. 15, 1992.
"Halloween", Link Magazine, Sep. 1992.
"Now More Than Ever", Supermarket Floral, Sep. 15, 1992.
Le Plant Sac Advertisement, published prior to Sep. 26, 1987.

(List continued on next page.)

*Primary Examiner*—John Sipos
*Assistant Examiner*—Louis Huynh
(74) *Attorney, Agent, or Firm*—Dunlap, Codding & Rogers, P.C.

(57) ABSTRACT

A portable apparatus for securing a decorative cover about a flower pot. The apparatus includes a frame assembly, an extension member having a cover support assembly, and a plurality of legs. The frame assembly includes a body member having an opening. The opening is sized and configured to permit passage of the flower pot through the opening. The extension member extends in an upwardly direction from the body member. The cover support assembly is connected to the extension member for supporting a decorative cover comprising at least one sleeve or sheet of material. The plurality of legs extend from and are spatially disposed about the body member such that the legs cooperate to support at least one band. As the flower pot moves through the opening in the body member, at least one of the bands is removed from the plurality of legs and moved about the decorative cover disposed about the flower pot.

10 Claims, 5 Drawing Sheets

U.S. PATENT DOCUMENTS

| | | | | | |
|---|---|---|---|---|---|
| 1,446,563 | A | | 2/1923 | Hughes | |
| 1,520,647 | A | | 12/1924 | Hennigan | |
| 1,525,015 | A | | 2/1925 | Weeks | |
| 1,610,652 | A | | 12/1926 | Bouchard | |
| 1,697,751 | A | | 1/1929 | Blake | 229/87 |
| 1,794,212 | A | | 2/1931 | Snyder | |
| 1,811,574 | A | | 6/1931 | Barrett | |
| 1,863,216 | A | | 6/1932 | Wordingham | |
| 1,978,631 | A | | 10/1934 | Herrlinger | 91/68 |
| 2,048,123 | A | | 7/1936 | Howard | 229/87 |
| RE21,065 | E | | 5/1939 | Copeman | 93/2 |
| 2,170,147 | A | | 8/1939 | Lane | 206/56 |
| 2,200,111 | A | | 5/1940 | Bensel | 229/1.5 |
| 2,278,673 | A | | 4/1942 | Savada et al. | 154/43 |
| 2,302,259 | A | | 11/1942 | Rothfuss | 41/10 |
| 2,323,287 | A | | 7/1943 | Amberg | 229/53 |
| 2,355,559 | A | | 8/1944 | Renner | 229/8 |
| 2,371,985 | A | | 3/1945 | Freiberg | 206/46 |
| 2,510,120 | A | | 6/1950 | Leander | 117/122 |
| 2,529,060 | A | | 11/1950 | Trillich | 117/68.5 |
| 2,621,142 | A | | 12/1952 | Wetherell | 154/117 |
| 2,648,487 | A | | 8/1953 | Linda | 229/55 |
| 2,688,354 | A | | 9/1954 | Berger | 150/28 |
| 2,774,187 | A | | 12/1956 | Smithers | 47/41 |
| 2,822,287 | A | | 2/1958 | Avery | 117/14 |
| 2,846,060 | A | | 8/1958 | Yount | 206/58 |
| 2,850,842 | A | | 9/1958 | Eubank, Jr. | 47/58 |
| 2,883,262 | A | | 4/1959 | Borin | 21/56 |
| 2,989,828 | A | | 6/1961 | Warp | 53/390 |
| 3,022,605 | A | | 2/1962 | Reynolds | 47/58 |
| 3,080,680 | A | | 3/1963 | Reynolds | 47/37 |
| 3,094,810 | A | | 6/1963 | Kalpin | 47/37 |
| 3,121,647 | A | | 2/1964 | Harris et al. | 118/202 |
| 3,271,922 | A | | 9/1966 | Wallerstein et al. | 53/3 |
| 3,293,100 | A | | 12/1966 | Questel | |
| 3,316,675 | A | | 5/1967 | Cartwright, Jr. | |
| 3,322,325 | A | | 5/1967 | Bush | 229/62 |
| 3,376,666 | A | | 4/1968 | Leonard | 47/41 |
| 3,380,646 | A | | 4/1968 | Doyen et al. | 229/57 |
| 3,431,706 | A | | 3/1969 | Stuck | 53/390 |
| 3,508,372 | A | | 4/1970 | Wallerstein et al. | 53/3 |
| 3,510,054 | A | | 5/1970 | Sanni et al. | 229/66 |
| 3,512,700 | A | | 5/1970 | Evans et al. | 229/53 |
| 3,550,318 | A | | 12/1970 | Remke et al. | 47/37 |
| 3,552,059 | A | | 1/1971 | Moore | 47/41.12 |
| 3,554,434 | A | | 1/1971 | Anderson | 229/55 |
| 3,556,389 | A | | 1/1971 | Gregoire | 229/53 |
| 3,557,516 | A | | 1/1971 | Brandt | 53/14 |
| 3,767,104 | A | | 10/1973 | Bachman et al. | 229/7 |
| 3,793,799 | A | | 2/1974 | Howe | 53/32 |
| 3,869,828 | A | | 3/1975 | Matsumoto | 47/34.11 |
| 3,888,443 | A | | 6/1975 | Flanigen | 248/152 |
| 3,962,503 | A | | 6/1976 | Crawford | 428/40 |
| 4,043,077 | A | | 8/1977 | Stonehocker | 47/66 |
| 4,054,697 | A | | 10/1977 | Reed et al. | 428/40 |
| 4,091,925 | A | | 5/1978 | Griffo et al. | 206/423 |
| 4,113,100 | A | | 9/1978 | Soja et al. | 206/602 |
| 4,118,890 | A | | 10/1978 | Shore | 47/28 |
| 4,149,339 | A | | 4/1979 | Hall et al. | 47/67 |
| 4,189,868 | A | | 2/1980 | Tymchuck et al. | 47/84 |
| 4,216,620 | A | | 8/1980 | Weder et al. | 47/72 |
| 4,248,347 | A | | 2/1981 | Trimbee | 206/423 |
| D259,333 | S | | 5/1981 | Charbonneau | D9/306 |
| 4,265,049 | A | | 5/1981 | Gorewitz | 47/26 |
| 4,280,314 | A | | 7/1981 | Stuck | 53/241 |
| 4,297,811 | A | | 11/1981 | Weder | 47/72 |
| 4,333,267 | A | | 6/1982 | Witte | 47/84 |
| 4,347,686 | A | | 9/1982 | Wood | 47/73 |
| 4,380,564 | A | | 4/1983 | Cancio et al. | 428/167 |
| 4,400,910 | A | | 8/1983 | Koudstall et al. | 47/84 |
| 4,413,725 | A | | 11/1983 | Bruno et al. | 206/45.33 |
| 4,442,765 | A | * | 4/1984 | Limehouse et al. | 53/390 |
| 4,508,223 | A | | 4/1985 | Catrambone | 206/423 |
| D279,279 | S | | 6/1985 | Wagner | D11/143 |
| 4,570,415 | A | * | 2/1986 | Centeno | 53/390 |
| 4,621,733 | A | | 11/1986 | Harris | 206/423 |
| 4,633,536 | A | * | 1/1987 | Tribble-DuBose | 4/460 |
| 4,640,079 | A | | 2/1987 | Stuck | 53/390 |
| 4,717,262 | A | | 1/1988 | Roen et al. | 383/120 |
| 4,733,521 | A | | 3/1988 | Weder et al. | 53/580 |
| 4,765,464 | A | | 8/1988 | Ristvedt | 206/0.82 |
| 4,771,573 | A | | 9/1988 | Stengel | 47/67 |
| 4,773,182 | A | | 9/1988 | Weder et al. | 47/72 |
| 4,801,014 | A | | 1/1989 | Meadows | 206/423 |
| 4,835,834 | A | | 6/1989 | Weder | 29/525 |
| D301,991 | S | | 7/1989 | Van Sant | D11/149 |
| 4,877,068 | A | * | 10/1989 | Blake | 53/390 |
| 4,941,572 | A | | 7/1990 | Harris | 206/423 |
| 4,946,290 | A | | 8/1990 | Matyja | 383/10 |
| 4,980,209 | A | | 12/1990 | Hill | 428/34.1 |
| 4,989,396 | A | | 2/1991 | Weder et al. | 53/397 |
| D315,700 | S | | 3/1991 | Stephens | D11/151 |
| 5,073,161 | A | | 12/1991 | Weder et al. | 493/154 |
| 5,074,675 | A | | 12/1991 | Osgood | 383/122 |
| 5,076,011 | A | | 12/1991 | Stehouwer | |
| 5,105,599 | A | | 4/1992 | Weder | 53/399 |
| 5,111,638 | A | | 5/1992 | Weder | 53/397 |
| 5,117,584 | A | | 6/1992 | Ottenwalder et al. | |
| 5,120,382 | A | | 6/1992 | Weder | 156/212 |
| 5,152,100 | A | | 10/1992 | Weder et al. | 47/72 |
| 5,181,364 | A | | 1/1993 | Weder | 53/397 |
| D335,105 | S | | 4/1993 | Ottenwalder et al. | D11/164 |
| 5,199,242 | A | | 4/1993 | Weder et al. | 53/397 |
| 5,205,108 | A | | 4/1993 | Weder et al. | 53/397 |
| 5,228,234 | A | | 7/1993 | de Klerk et al. | 47/41.01 |
| 5,235,782 | A | | 8/1993 | Landau | 47/72 |
| 5,239,775 | A | | 8/1993 | Landau | 47/72 |
| 5,249,407 | A | | 10/1993 | Stuck | 53/399 |
| 5,259,106 | A | | 11/1993 | Weder et al. | 29/469.5 |
| 5,307,606 | A | | 5/1994 | Weder | 53/410 |
| 5,309,580 | A | * | 5/1994 | Amalsad et al. | 4/483 |
| 5,310,102 | A | * | 5/1994 | Hougham | 224/585 |
| 5,315,785 | A | | 5/1994 | Avôt et al. | 47/72 |
| 5,339,601 | A | | 8/1994 | Weder et al. | |
| 5,350,240 | A | | 9/1994 | Billman et al. | 383/104 |
| 5,353,575 | A | | 10/1994 | Stepanek | 53/461 |
| 5,361,482 | A | | 11/1994 | Weder et al. | 29/469 |
| 5,388,695 | A | | 2/1995 | Gilbert | 206/423 |
| 5,402,599 | A | | 4/1995 | Weder et al. | |
| 5,410,856 | A | | 5/1995 | Weder et al. | |
| 5,417,033 | A | | 5/1995 | Weder | |
| 5,426,914 | A | | 6/1995 | Weder et al. | |
| 5,428,939 | A | | 7/1995 | Weder et al. | 53/397 |
| 5,443,670 | A | | 8/1995 | Landau | 156/191 |
| 5,450,707 | A | | 9/1995 | Weder et al. | |
| 5,452,560 | A | | 9/1995 | Weder et al. | |
| 5,465,552 | A | | 11/1995 | Weder et al. | |
| 5,465,553 | A | | 11/1995 | Weder et al. | |
| 5,471,816 | A | | 12/1995 | Weder et al. | |
| 5,481,850 | A | | 1/1996 | Weder et al. | |
| 5,493,809 | A | | 2/1996 | Weder et al. | 47/72 |
| D368,025 | S | | 3/1996 | Sekerak et al. | D9/305 |
| 5,496,251 | A | | 3/1996 | Cheng | 493/224 |
| 5,496,252 | A | | 3/1996 | Gilbert | 493/224 |
| 5,509,590 | A | * | 4/1996 | Medeiros et al. | 224/161 |
| 5,526,932 | A | | 6/1996 | Weder | 206/423 |
| 5,531,058 | A | | 7/1996 | Weder | |
| 5,542,169 | A | | 8/1996 | Weder | |
| 5,551,140 | A | | 9/1996 | Weder et al. | |
| 5,551,570 | A | | 9/1996 | Shaffer et al. | 206/575 |
| 5,572,849 | A | | 11/1996 | Weder et al. | 53/399 |

| | | | | | |
|---|---|---|---|---|---|
| 5,572,851 | A | | 11/1996 | Weder | 53/399 |
| 5,575,133 | A | | 11/1996 | Weder et al. | 53/397 |
| 5,588,277 | A | | 12/1996 | Weder et al. | |
| 5,590,508 | A | | 1/1997 | Weder et al. | |
| 5,609,009 | A | | 3/1997 | Weder et al. | |
| 5,611,192 | A | * | 3/1997 | Weder | 53/390 |
| 5,615,532 | A | | 4/1997 | Weder et al. | |
| 5,617,702 | A | | 4/1997 | Weder | |
| 5,617,703 | A | | 4/1997 | Weder | 53/413 |
| 5,617,708 | A | | 4/1997 | Weder et al. | |
| 5,623,807 | A | | 4/1997 | Weder et al. | |
| 5,624,320 | A | | 4/1997 | Martinez | 472/51 |
| 5,625,936 | A | | 5/1997 | Weder | |
| 5,625,979 | A | | 5/1997 | Weder | |
| 5,632,131 | A | | 5/1997 | Weder et al. | |
| 5,636,502 | A | | 6/1997 | Weder et al. | |
| 5,647,168 | A | | 7/1997 | Gilbert | 47/72 |
| 5,647,189 | A | | 7/1997 | Weder et al. | |
| 5,647,193 | A | | 7/1997 | Weder et al. | 53/465 |
| 5,652,975 | A | * | 8/1997 | Hoskin | 4/483 |
| 5,661,952 | A | | 9/1997 | Weder et al. | |
| 5,687,546 | A | | 11/1997 | Weder et al. | |
| 5,706,605 | A | | 1/1998 | Alcazar | 47/65.7 |
| 5,706,628 | A | * | 1/1998 | Craig et al. | 53/399 |
| 5,715,944 | A | | 2/1998 | Windisch | 206/423 |
| 5,724,790 | A | | 3/1998 | Weder | |
| 5,735,103 | A | | 4/1998 | Weder | 53/399 |
| 5,740,656 | A | | 4/1998 | Weder et al. | |
| 5,740,664 | A | | 4/1998 | Weder et al. | |
| 5,758,472 | A | | 6/1998 | Weder | |
| 5,761,879 | A | | 6/1998 | Weder et al. | |
| 5,781,981 | A | | 7/1998 | Weder et al. | |
| 5,782,062 | A | | 7/1998 | Weder et al. | |
| 5,813,194 | A | | 9/1998 | Weder | 53/399 |
| 5,813,198 | A | | 9/1998 | Weder et al. | |
| 5,839,256 | A | | 11/1998 | Weder et al. | |
| D404,684 | S | | 1/1999 | Shea | D11/164 |
| 5,890,343 | A | | 4/1999 | Weder et al. | |
| 5,913,799 | A | | 6/1999 | Weder et al. | |
| 5,921,060 | A | | 7/1999 | Straeter | |
| 5,924,241 | A | | 7/1999 | Hodge | 47/72 |
| 5,941,020 | A | | 8/1999 | Weder | 47/72 |
| 5,966,866 | A | | 10/1999 | Ferguson | 47/41.01 |
| 5,974,730 | A | | 11/1999 | Chien | 47/41.01 |
| 5,974,765 | A | | 11/1999 | Weder et al. | |
| 5,991,999 | A | | 11/1999 | Weder | |
| D419,436 | S | | 1/2000 | Celtorius et al. | D9/305 |
| 6,009,665 | A | | 1/2000 | Weder | |
| 6,009,687 | A | | 1/2000 | Weder | 53/399 |
| 6,014,852 | A | | 1/2000 | Weder et al. | |
| 6,047,524 | A | | 4/2000 | Weder | 53/399 |
| D424,972 | S | | 5/2000 | Ferguson | D11/143 |
| 6,080,453 | A | | 6/2000 | Weder et al. | |
| 6,082,045 | A | | 7/2000 | Weder et al. | |
| 6,098,336 | A | | 8/2000 | Ferguson | 206/423 |
| 6,101,788 | A | | 8/2000 | Weder et al. | |
| 6,101,789 | A | | 8/2000 | Weder et al. | |
| 6,112,500 | A | | 9/2000 | Weder et al. | |
| 6,129,208 | A | | 10/2000 | Ferguson | 206/423 |
| 6,129,209 | A | | 10/2000 | Tchira | 206/423 |
| 6,141,906 | A | | 11/2000 | Weder | 47/72 |
| 6,178,727 | B1 | | 1/2001 | Weder et al. | |
| 6,182,395 | B1 | | 2/2001 | Weder | 47/72 |
| 6,183,590 | B1 | | 2/2001 | Weder | |
| 6,269,611 | B1 | | 8/2001 | Weder et al. | |
| 6,321,435 | B1 | | 11/2001 | Weder | |
| 6,345,488 | B2 | | 2/2002 | Weder et al. | |
| 6,370,840 | B2 | | 4/2002 | Weder et al. | |
| 6,502,368 | B1 | | 1/2003 | Grether | |
| 6,561,395 | B2 | * | 5/2003 | Lim et al. | 224/628 |

FOREIGN PATENT DOCUMENTS

| | | |
|---|---|---|
| DE | 513971 | 11/1930 |
| DE | 1166692 | 3/1964 |
| DE | 1962947 | 6/1971 |
| DE | 2060812 | 11/1971 |
| DE | 2748626 | 5/1979 |
| DE | 3445799 | 6/1986 |
| DE | 3829281 | 5/1989 |
| DE | 3911847 | 10/1990 |
| DK | 1204647 | 9/1970 |
| EP | 0050990 | 5/1982 |
| EP | 0791543 | 8/1997 |
| FR | 1376047 | 9/1964 |
| FR | 2036163 | 12/1970 |
| FR | 2137325 | 12/1972 |
| FR | 2272914 | 12/1975 |
| FR | 2489126 | 3/1982 |
| FR | 2567068 | 7/1984 |
| FR | 2610604 | 8/1988 |
| FR | 2603159 | 3/1989 |
| FR | 2619698 | 3/1989 |
| GB | 5605 | 5/1885 |
| GB | 2056410 | 3/1981 |
| GB | 2074542 | 11/1981 |
| GB | 2128083 | 4/1984 |
| GB | 2203127 | 10/1988 |
| GB | 2212136 | 7/1989 |
| GB | 2252708 | 8/1992 |
| IT | 224507 | 4/1996 |
| JP | 542958 | 2/1993 |
| JP | 6127555 | 5/1994 |
| JP | 8-19334 | 1/1996 |
| NL | 8301709 | 12/1984 |
| NL | 1000658 | 1/1996 |
| WO | 9315979 | 8/1993 |
| WO | 9712819 | 4/1997 |

OTHER PUBLICATIONS

"A World of Cut Flower and Pot Plant Packaging" Brochure, Klerk's Plastic Products Manufacturing, Inc., published prior to Mar. 31, 1994, 6 pages.

Chantler & Chantler brochure showing Zipper Sleeve™ and Florasheet®, published prior to Mar. 31, 1994, 2 pages.

"Stand Alone Plastic Bagmaking" brochure, AMI, Atlanta, GA, Feb. 15, 1996, 2 pages.

"Foil Jackets" brochure, Custom Medallion, Inc., Dec., 1996, 2 pages.

"Derwent Abstract" of FR 2610604A. It is noted that the abstract is an incorrect English translation of the contents of the French patent. The French patent does not enable or disclose adhesively attaching the covering to the container. 1988.

"Silver Linings" Brochure, Affinity Diversified Industries, Inc., 1986. The Silver Linings brohcure shows a floral sleeve with a closed bottom. The brochure shows, in one embodiment, a vase with flowers inside a "cut flower" sleeve with the sleeve tied with a ribbon about the neck of the vase.

"Special Occasion Printed Highlophane Bags" Brochure, Highland Supply Corporation, 1990, 2 pages.

"Creative Packaging" Brochure, John Henry Company, Sep. 1992.

"Make Highlander Your Headquarters" Brochure, Highland Supply Corporation, 1991.

Weder et al., "Sleeve with a Triangular Lower End", U.S. patent application Publication, Pub. No. US 2002/0112401 A1, Pub. Date: Aug. 22, 2002.

* cited by examiner

APPARATUS FOR SECURING A DECORATIVE COVER ABOUT A FLOWER POT

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

Field of the Invention

The present invention relates to a banding apparatus and a method for placing a band about a decorative cover and more particularly, but not by way of limitation, to a portable banding apparatus and method for securing the decorative cover about at least a portion of an outer peripheral surface of a flower pot utilizing the portable banding apparatus.

DETAILED DESCRIPTION OF THE INVENTION

Figure 1:
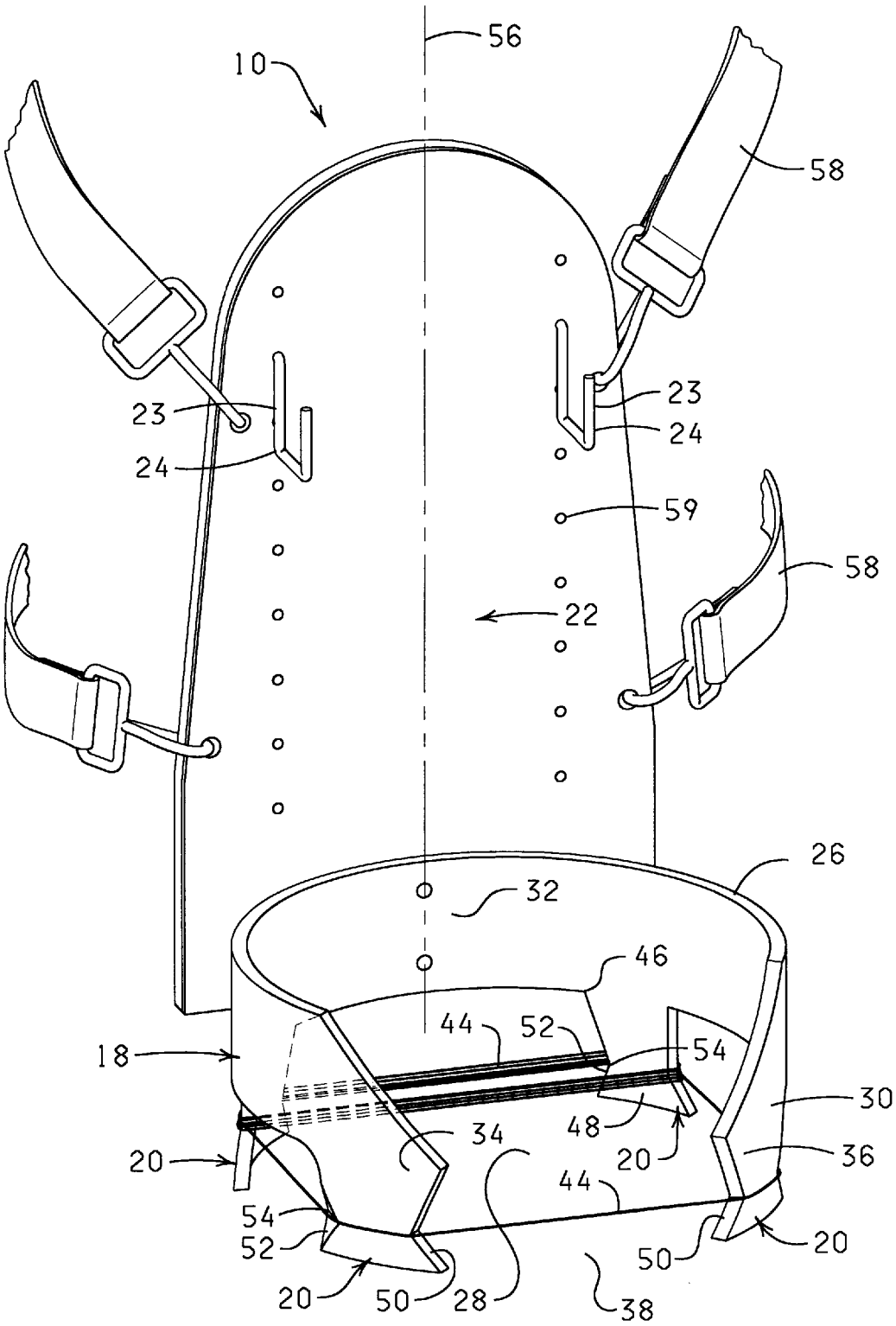
FIG. 1 is a perspective view of a portable banding apparatus constructed in accordance with the present invention.
Figure 4:
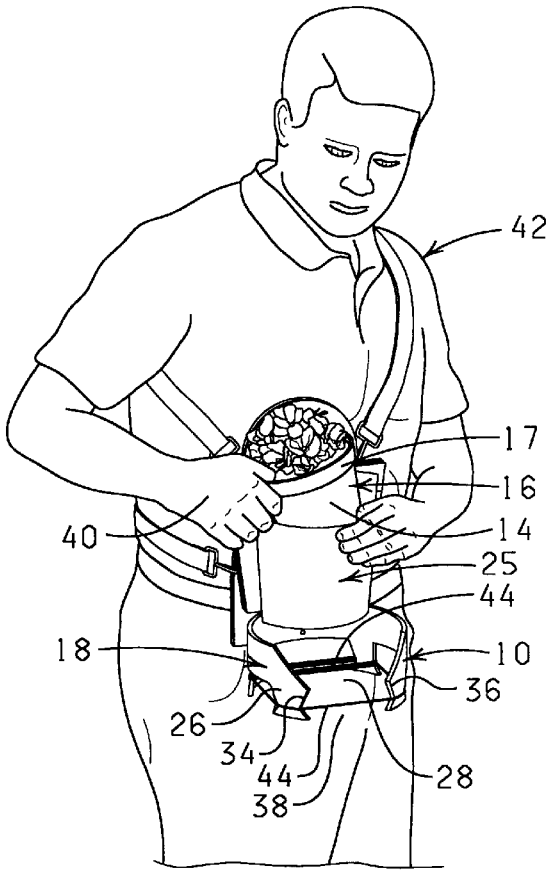
FIG. 4 is a perspective view of FIG. 3 wherein a decorative cover is being disposed about a flower pot utilizing the portable banding apparatus.
Figure 5:
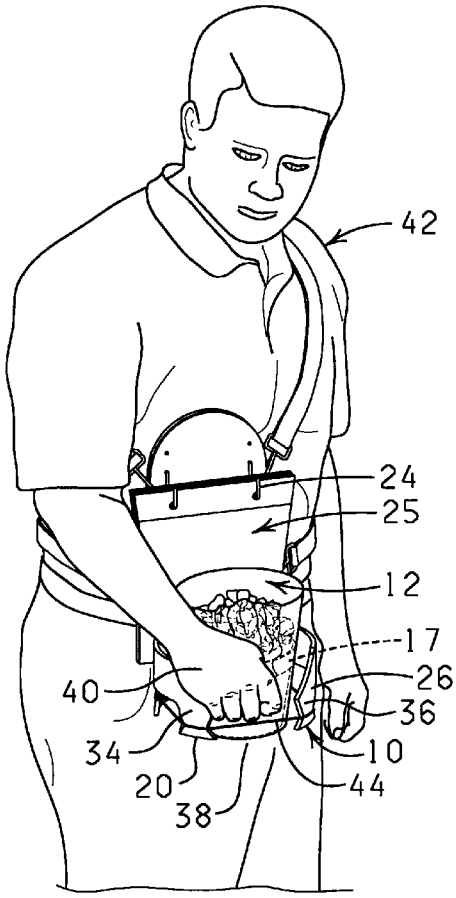
FIG. 5 is a perspective view of FIG. 4 wherein the flower pot having the decorative cover disposed about an outer peripheral surface thereof is moved through an opening in the portable banding apparatus to position a band about the decorative cover.
Figure 6:
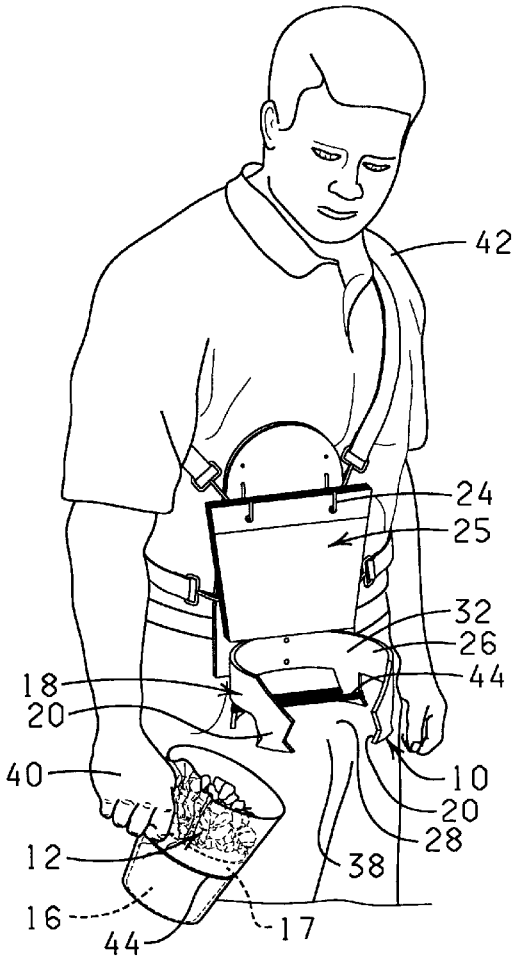
FIG. 6 is a perspective view of FIG. 5 wherein the flower pot having the decorative cover secured thereabout by the band has been removed from the portable banding apparatus.
Figure 7:
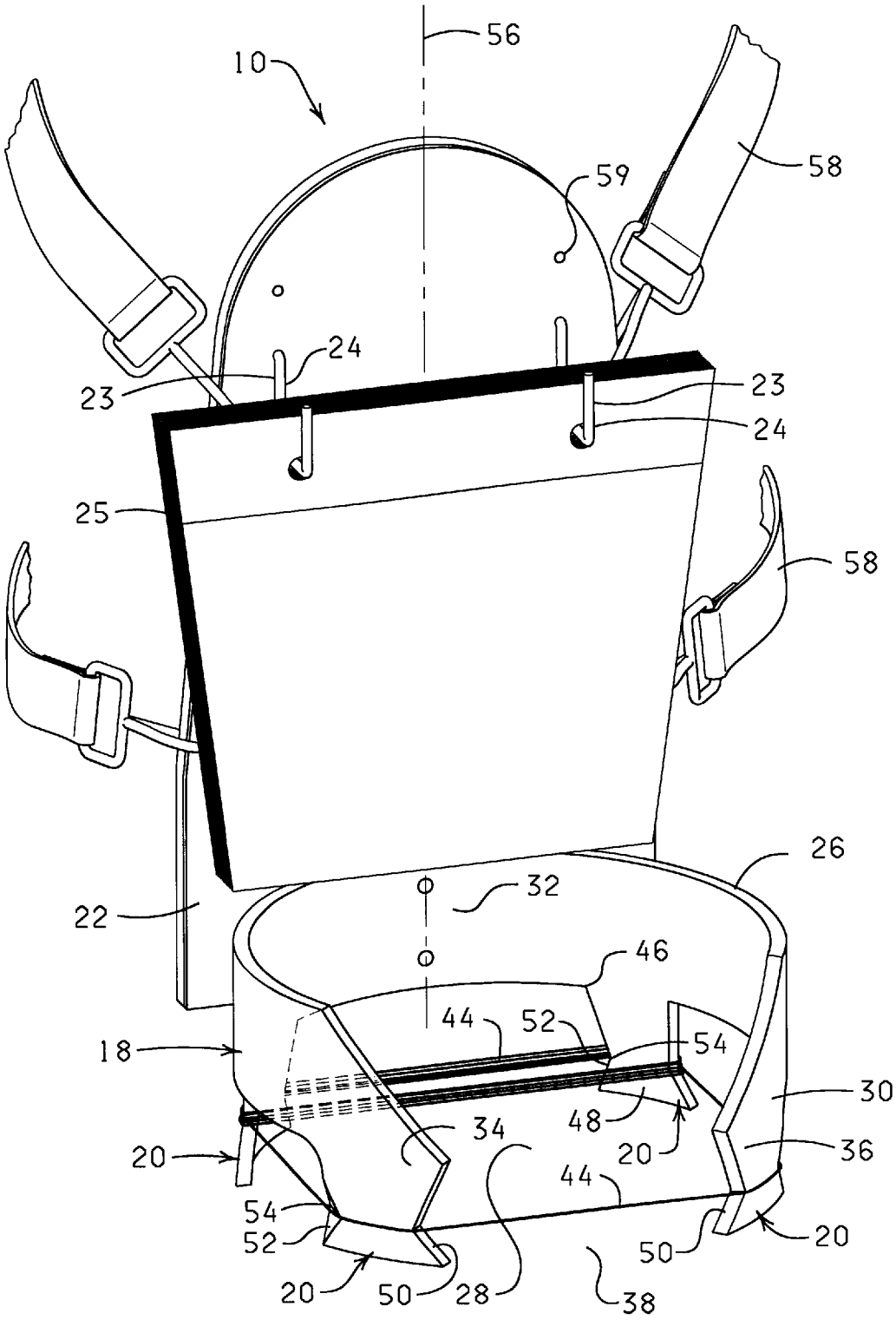
FIG. 7 is a perspective view of the portable banding apparatus of FIG. 1 having sheets of material disposed thereon.

Referring now to the drawings, and more particularly to FIGS. 1 and 7, shown therein is a portable banding apparatus 10 for securing a decorative cover 12 (FIGS. 5 and 6) about at least a portion of an outer peripheral surface 14 of a flower pot 16 having an upper end 17 (FIG. 4). It should be understood that the term "decorative cover" as used herein refers to a cover formed from a sleeve and/or at least one sheet of material which is disposed about the outer peripheral surface 14 of the flower pot 16.

Figure 3:
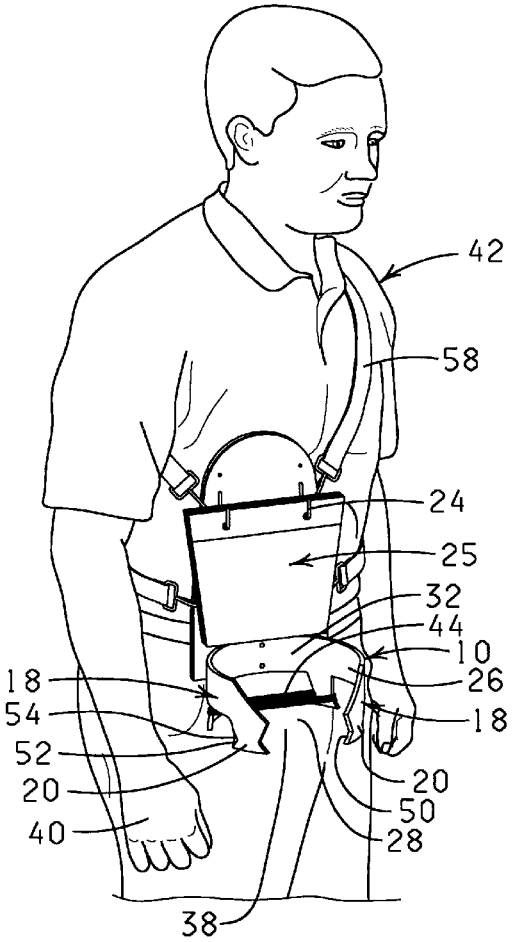
FIG. 3 is a perspective view of the portable banding apparatus of FIG. 1 attached to a person.

The portable banding apparatus 10 includes a frame assembly 18, a plurality of legs 20, and an extension member 22 having a cover support assembly 23, for example, a pair of hooks 24 for securing a plurality of sleeves 25*a* (FIG. 3) or sheets of material 25*b* (FIG. 7) utilized to form the decorative cover 12. The portable banding apparatus 10 may be fabricated of any suitable material, such as plastic, ceramic, wood, metal or a polymeric material.

The frame assembly 18 includes a body member 26 having an opening 28 extending therethrough, a front side 30 and a back side 32. The opening 28 is sized and configured to permit passage of the flower pot 16 with the decorative cover 12 disposed about at least a portion thereof, through the opening 28 in the body member 26. The body member 26 is provided with an arcuate configuration and has a first end 34 and a second end 36. However, it should be understood that the body member 26 and the opening 28 can be of any size and configuration, and such will be dependent upon the size and configuration of the flower pot 16. The first end 34 and the second end 36 of the body member 26 are each configured to angle upwardly and inwardly and are spatially disposed as to form a passageway 38 therebetween. The passageway 38 is sized and configured so that a hand 40 of a person 42 (FIGS. 3–6) may pass therethrough (FIG. 5) upon removal of a band 44 from the plurality of legs 20 and placement of the band 44 around the decorative cover 12 while passing the flower pot 16 having the decorative cover 12 disposed about at least a portion of the outer peripheral surface 14 of the flower pot 16 through the opening 28 of the body member 26.

The plurality of legs 20, four legs being shown, are spatially disposed about the body member 26. It should be understood that while the portable banding apparatus 10 has been shown with four legs 20, any number of legs 20 can be used so long as the legs 20 are spatially disposed from one another and extend a distance from a lower end 46 of the body member 26 such that when one or more of the bands 44 is disposed about the legs 20, the legs 20 cooperate to support at least one band 44 in an open position so as to permit passage of the flower pot 16 having the decorative cover 12 disposed about at least a portion of the outer peripheral surface 14 of the flower pot 16 therethrough. A distal end portion 48 of each of the legs 20 extends a distance from the lower end 46 of the body member 26. The distal end portion 48 of each of the legs 20 are configured to supportingly receive at least one band 44. The term "band" as used herein is to be understood to mean any material which may be secured about an object such as the flower pot 16. Such bands commonly being referred to as elastic bands or rubber bands and also includes any other type of material such as a string or metal or rubber or plastic or ribbon or cloth or stribbon which may be secured about an object such as the flower pot 16. The band 44 also may include a bow, if desired, in a particular application.

One of the legs 20 is substantially aligned with each of the first end 34 and the second end 36 of the body member 26 and two of the legs 20 are disposed along a portion of the back side 32 of the body member 26 such that the legs 20 are spatially disposed about the body member 26. Each of the legs 20 is provided with a forward extending angular disposed foot portion 50 and a rearward portion 52 having a triangular recess 54 for receiving, supporting, and enhancing removal of the band 44 when the band 44 is supported on the legs 20.

The extension member 22 of the portable banding apparatus 10 extends in an upwardly direction from the body member 26 such that an elongated axis 56 of the extension member 22 is disposed substantially perpendicular to the body member 26. The extension member 22 enables the portable banding apparatus 10 to be secured to the person 42 (FIGS. 3–6) by straps 58 that are attached to the extension member 22. It should be understood that other means can be utilized for connecting the portable banding apparatus 10 to the person 42, such as a belt, a strap, a clip, or a hook. The hooks 24 are connected to the extension member 22 such that a pad or plurality of sleeves 25*a* and/or sheets of material 25*b* can be supported on the extension member 22. While hooks have been shown for supporting the plurality of sleeves 25*a* and/or sheets of material 25*b* on the extension member 22, any suitable cover support assembly 23 capable of supporting the plurality of sleeves 25*a* and/or sheets of material 25*b* on the extension member 22 can be employed, including, but limited to clips, wickets, staples, or straps. The extension member 22 is also preferably provided with a plurality of apertures 59 extending vertically along the extension member 22 to support the hooks 24 so as to accommodate varying sizes of sleeves 25*a* and/or sheets of material 25*b*.

Figure 2:
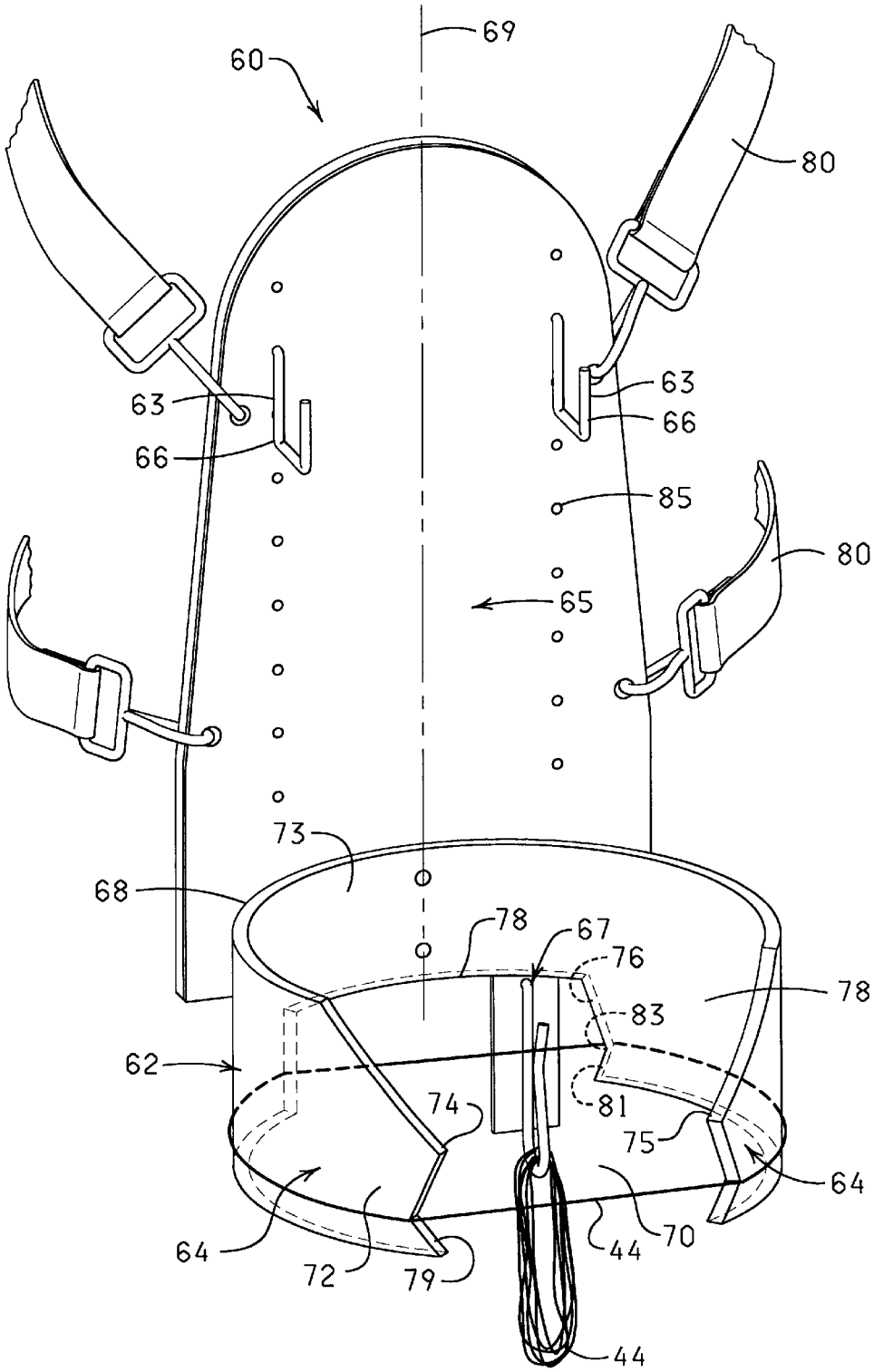
FIG. 2 is a perspective view of another embodiment of a portable banding apparatus constructed in accordance with the present invention.

Referring now to FIG. 2, another embodiment of a portable banding apparatus 60 is shown. The portable banding apparatus 60 is similar to the portable banding apparatus 10 hereinbefore described except as described hereinafter. That is, the portable banding apparatus 60 is provided with a frame assembly 62, an extension member 65, a cover support assembly 63 comprising a pair of hooks 66, and a band support member 67. The frame assembly 62 includes a body member 68 having an opening 70 extending therethrough. The body member 68 has a front side 72, a back side 73, a first end 74, and a second end 75. The opening 70 is sized and configured to permit passage of the flower pot 16 having the decorative cover 12 disposed about at least a portion of the outer peripheral surface 14 thereof through the opening 70 in the body member 68.

The portable banding apparatus 60 differs form the portable banding apparatus 10 in that the portable banding apparatus 60 is provided with two legs 64. The legs 64 are spatially disposed about the body member 68 substantially as shown. A distal end portion 76 of each of the legs 64 extends a distance from a lower end 78 of the body member 68. The distal end portion 76 of the legs 64 are adapted to supportingly receive at least one band 44.

One of the legs 64 is substantially aligned with each of the first and second ends 74 and 75, respectively, of the body member 68 and each of the legs 64 extend along the body member 68 toward the back side 73 of the body member 68 substantially as shown. Each of the legs 64 is provided with a forward extending angular disposed foot portion 79 and a rearward portion 81 having a triangular recess 83 for receiving, supporting, and enhancing removal of the band 44 supported on the legs 64 of the portable banding apparatus 60.

The extension member 65 of the portable banding apparatus 60 extends in an upwardly direction from the body member 68 such that an elongated axis 69 of the extension member 65 is disposed substantially perpendicular to the body member 68. Straps 80 are attached to the extension member 65 for securing the banding apparatus 60 to the person 42. The hooks 66 and the band support member 67 are connected to the extension member 65. The hooks 66 function to support at least one sleeve 25*a* or sheet of material 25*b* and the band support member 67 supports at least one band 44. While hooks have been shown for securing the plurality of sleeves 25*a* and/or sheets of material 25*b* to the extension member 65, any suitable cover support assembly 63 capable of supporting the plurality of sleeves 25*a* and/or sheets of material 25*b* on the extension member 65 can be employed, including, but not limited to clips, wickets, staples, or straps. The extension member 65 is also preferably provided with a plurality of apertures 85 extending vertically along the extension member 65 to support the hooks 66 so as to accommodate varying sizes of sleeves 25*a* and/or sheets of material 25*b*.

The use of the portable banding apparatus 10 and 60 is similar. Thus, only the use of the portable banding apparatus 10 for securing the decorative cover 12 about the outer peripheral surface 14 of the flower pot 16 will be described hereinafter with reference to FIGS. 3–6. It should be noted that the unique structure of the portable banding apparatus 10, which permits the portable banding apparatus 10 to be secured to the person 42, eliminates the necessity of providing a centralized banding location. That is, the person 42 may walk around the greenhouse or nursery and select desired plants and form the decorative cover 12 about the flower pot 16 and, depending on the size of the sleeve 25*a* and/or sheet of material 25*b*, a protective cover about a floral grouping (not shown) disposed about at least a portion of the outer peripheral surface 14 of the flower pot 16 and secured with a band 44 to produce the decorative cover 12.

First, the portable banding apparatus 10 is secured to the person 42 by the straps 58 or other means, such as a belt, strap, clip, or hook. Once the portable banding apparatus 10 is secured to the person 42, the person 42 is then able to walk around the greenhouse or nursery and select desired plants for securing the decorative cover 12 about the outer peripheral surface 14 of each of the selected plants.

Next, the person 42 positions at least one band 44, being supported by the plurality of legs 20 on the back side 32 of the body member 26, about all the plurality of legs 20. To produce the decorative cover 12, the person 42 takes at least one sleeve 25*a* supported by the hooks 24, opens the sleeve 25*a* and places the flower pot 16 into the sleeve 25*a*. The sleeve 25*a* can be removed from the hooks 24 prior to positioning the flower pot 16 into the open sleeve 25*a* or the flower pot 16 can be placed into the sleeve 25*a* and then be removed from the hooks 24. With the decorative cover 12 disposed about at least a portion of the outer peripheral surface 14 of the flower pot 16, the person 42 moves the flower pot 16, having the decorative cover 12 disposed about at least a portion of the outer peripheral surface 14 of the flower pot, into the opening 28 in the body member 26 of the frame assembly 18 of the portable banding apparatus 10. The person 42 removes the band 44 from the plurality of legs 20 and positions the band 44 about the decorative cover 12 thus securing the decorative cover 12 about at least a portion of the outer peripheral surface 14 and either below or about the upper end 17 of the flower pot 16. The hand 40 of the person 42 passes through the passageway 38, which is formed between the first end 34 and the second end 36 of the body member 26, as the flower pot 16 with the decorative cover 12 secured about at least a portion of the outer peripheral surface 14 of the flower pot 16 by the band 44 is moved through the opening 28 of the portable banding apparatus 10. The person 42 then removes at least one other band 44 from the plurality of legs 20 and disposes the band 44 about all the plurality of legs 20 to prepare for securing another decorative cover 12 about another flower pot 16. This procedure of securing the decorative cover 12 about the flower pot 16 will continue until the person 42 has completed the required task.

From the above description, it is clear that the present invention is well-adapted to carry out the objects and to attain the advantages mentioned herein as well as those inherent in the invention. While a presently preferred embodiment of the invention has been described, for purposes of this disclosure, it will be understood that numerous changes may be made which will readily suggest themselves to those skilled in the art and which are accomplished within the spirit of the invention disclosed and as defined, in the appended claims.

What is claimed is:

1. A portable banding apparatus for securing a decorative cover about at least a portion of an outer peripheral surface of a flower pot, the apparatus comprising:

a frame assembly comprising a body member having a front side and a back side, and an opening extending therethrough, the opening sized and configured to permit passage of the flower pot having the decorative cover disposed about at least a portion thereof through the opening in the body member having spaced frist and second ends, the body member forming a passageway sized and configured so that a hand of a person may pass therethrough while passing the flower pot having the decorative cover disposed about at least a portion thereof through the opening of the body member;

an extension member extending in an upwardly direction from the body member such that an elongated axis of the extension member is disposed substantially perpendicular to the body member;

a cover support assembly connected to the extension member for supporting at least one decorative cover; and a plurality of spatially disposed legs extending from the body member, the legs cooperating to support at least one band in an open position so as to permit passage of the flower pot having the decorative cover disposed about at least a portion of the outer peripheral surface of the flower pot therethrough whereby the band is removed from the legs and disposed about the decorative cover for securing the decorative cover about the flower pot.

2. The portable banding apparatus of claim 1 wherein at least one of the legs has a plurality of bands disposed thereon.

3. The portable banding apparatus of claim 1 wherein each of the legs is provided with a forward extending angular disposed foot portion and a rearward portion having a triangular recess for receiving and supporting the band on the leg of the portable banding apparatus.

4. The portable banding apparatus of claim 1 wherein the plurality of legs spatially disposed about the body member are substantially equal in length.

5. The portable banding apparatus of claim 1 wherein the cover support assembly is a hook, wicket, staple, clip, or strap.

6. A portable banding apparatus for securing a decorative cover about at least a portion of an outer peripheral surface of a flower pot, the apparatus comprising:

a frame assembly comprising a body member having a front side and a back side, and an opening extending therethrough, the opening sized and configured to permit passage of the flower pot having the decorative cover disposed about at least a portion thereof through the opening in the body member, the body member forming a passageway sized and configured so that a hand of a person may pass therethrough while passing the flower pot having the decorative cover disposed about at least a portion thereof through the opening of the body member wherein the body member of the frame assembly is further characterized as having an arcuate configuration whereby the body member has a first end and a second end, the first end and the second end of the body member spatially disposed so as to form the passageway therebetween, an extension member extending in an upwardly direction from the body member such that an elongated axis of the extension member is disposed substantially perpendicular to the body member;

a cover support assembly connected to the extension member for supporting at least one decorative cover; and a plurality of spatially disposed legs extending from the body member, the legs cooperating to support at least one band in an open position so as to permit passage of the flower pot having the decorative cover disposed about at least a portion of the outer peripheral surface of the flower pot therethrough whereby the band is removed from the legs and disposed about the decorative cover for securing the decorative cover about the flower pot.

7. The portable banding apparatus of claim 6 wherein the first end and the second end of the body member are each configured to angle upwardly and inwardly.

8. The portable banding apparatus of claim 6 wherein at least one leg is substantially aligned with each of the first and second ends of the body member.

9. The portable banding apparatus of claim 8 wherein at least one of the plurality of legs is disposed along a portion of the rear side of the body member.

10. A portable banding apparatus for securing a decorative cover about at least a portion of an outer peripheral surface of a flower pot, the apparatus comprising:

a frame assembly comprising a body member having a front side and a back side, and an opening extending therethrough, the opening sized and configured to permit passage of the flower pot having the decorative cover disposed about at least a portion thereof through the opening in the body member having spaced first and second ends, the body member forming a passageway sized and configured so that a hand of a person may pass therethrough while passing the flower pot having the decorative cover disposed about at least a portion thereof through the opening of the body member;

a plurality of legs spatially disposed about the body member, a distal end portion of each of the legs disposed a distance from a lower end of the body member, a distal end portion of the legs adapted to supportingly receive at least one band; and means for connecting the banding apparatus to a person.

* * * * *